US006894451B2

(12) United States Patent
Shinohara

(10) Patent No.: US 6,894,451 B2
(45) Date of Patent: May 17, 2005

(54) POWER WINDOW APPARATUS HAVING MECHANISM FOR DETECTING OBJECT BEING CAUGHT

(75) Inventor: Akihiko Shinohara, Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 10/796,654

(22) Filed: Mar. 9, 2004

(65) Prior Publication Data

US 2004/0178758 A1 Sep. 16, 2004

(30) Foreign Application Priority Data

Mar. 13, 2003 (JP) ..... 2003-068530

(51) Int. Cl.[7] ..... E05F 15/16

(52) U.S. Cl. ..... 318/566; 318/286; 318/469; 49/26

(58) Field of Search ..... 318/563, 565, 318/566, 264–266, 280–286, 466–469; 49/26–28; 307/9.1, 10.1

(56) References Cited

U.S. PATENT DOCUMENTS 4,900,994 A 2/1990 Mizuta
5,764,008 A * 6/1998 Hahn et al. ..... 318/256
5,774,046 A 6/1998 Ishihara et al.
5,932,931 A * 8/1999 Tanaka et al. ..... 307/10.1
6,150,784 A 11/2000 Nagaoka
6,704,471 B1 * 3/2004 Fowler et al. ..... 385/13

FOREIGN PATENT DOCUMENTS

JP 11-131909 5/1999

* cited by examiner

*Primary Examiner*—Bentsu Ro
(74) *Attorney, Agent, or Firm*—Brinks Hofer Gilson & Lione

(57) ABSTRACT

A power window apparatus includes a window glass having a horizontal side and an inclined side at the upper end thereof; a window frame for supporting the window glass; and a motor for vertically driving the window glass. In this power window apparatus, a parameter (for example, pulse period) corresponding to a load torque on the motor is measured; a first threshold to determine whether an object is caught between the horizontal side and the window frame, and a second threshold (which is smaller than the first threshold) to determine whether an object is caught between the inclined side and the window frame are set; and the measured parameter is compared with the corresponding set threshold to stop or reverse the motor when the parameter exceeds the threshold.

4 Claims, 4 Drawing Sheets

$$\tau = \frac{Kt}{Rm}(V - Ke \cdot 1/t) - Tm$$
$$= Kt\ I - Tm$$

1/t: PULSE FREQUENCY

Kt, Rm, Ke, Tm: CONSTANT OF MOTOR

POWER WINDOW APPARATUS HAVING MECHANISM FOR DETECTING OBJECT BEING CAUGHT

This application claims the benefit of priority to Japanese Patent Application No. 2003-068530, herein incorporated by reference.

BACKGROUND OF THE INVENTION

1. Field of the Invention

The present invention relates to techniques used in a power window apparatus for detecting that an object is caught. In particular, the present invention relates to a technique, in opening/closing a door window of an automobile, for preventing an excessive squeezing force from being applied to a caught object, and for preventing the door window from being erroneously stopped or reversed.

2. Description of the Related Art

In a known technique for detecting an object, a parameter that indicates a motor load imposed on the window glass, when opened/closed by a motor drive, is measured. Then, the measured parameter (motor load torque) is compared with a preset reference median. When the parameter is substantially deviated from the reference median, the motor is stopped or reversed based on the determination that an object is caught (see, for example, Japanese Unexamined Patent Application Publication No. 11-62380 (corresponding to U.S. Pat. No. 6,150,784)). According to this technique, the reference median is set within the entire range where an object can be detected, that is, the range between the fully-closed position and the fully-open position of the window glass, which is included in the entire moving range of the window glass.

In another known technique for detecting that an object is caught in a door window, an external force applied to the window glass is continuously monitored. Then, when a detected external force exceeds a threshold, a driving motor is stopped or reversed based on the determination that an object is caught (see, for example, Japanese Unexamined Patent Application Publication No. 11-131909). A first threshold and a second threshold that is smaller than the first threshold are used to determine whether an object is caught.

In Japanese Unexamined Patent Application Publication No. 11-62380, the reference median is a motor load torque required for a movement of the window glass when no object is caught. Practically, the motor load torque is made up of, for example, the weight of the window glass and the friction between the window glass and a sash, and varies depending on the position in the entire moving range of the window glass. Although the reference medians exist all over the moving range of the window glass, one given position in the moving range is associated with only one reference median.

In Japanese Unexamined Patent Application Publication No. 11-131909, the first threshold and the second threshold are set for detecting that an object is caught when a door of a hardtop vehicle is closed or opened. Therefore, one given position in the moving range of the window glass is associated with two thresholds. In Japanese Unexamined Patent Application Publication No. 11-62380, a value obtained by adding a certain level of an allowable reference value to the reference median is used to determine whether an object is caught. When a motor load imposed on the window glass exceeds this value, it is determined that an object is caught. This value corresponds to the thresholds described in Japanese Unexamined Patent Application Publication No. 11-131909. The allowable reference value is a value determined by converting a maximum allowable force, which can be applied to a caught object, into the motor load torque, or by making some corrections to this value. The maximum allowable force that can be applied is interpreted as an allowable squeezing force that can be applied to a caught object.

In a vehicle, especially an automobile, each window glass, particularly of front seats, normally has an inclined side in front and a horizontal side at the back. An object may be caught either at the inclined side or the horizontal side. When an object is caught at the horizontal side, an external force applied to the object can be detected as a motor load imposed on the window glass. On the other hand, when an object is caught at the inclined side, a less force, compared to the external force applied to the object, is detected as a motor load imposed on the window glass, due to the moment of force (the detail will be described in Description of the Embodiments).

Therefore, in the power window apparatus where only one threshold is provided for one given position in the moving range of the window glass, as disclosed in the above patent documents, even if an appropriate threshold, which is appropriate for detecting an object caught at the horizontal side, is set, an external force exceeding an allowable value may be applied to an object caught at the inclined side of the window. On the other hand, when a lower threshold appropriate for detecting an object caught at the inclined side is set, a minor incident occurring at the horizontal side leads to the determination that an object is caught. As a result, the motor for driving the window glass develops a tendency to malfunction and is, for example, stopped and reversed erroneously.

SUMMARY OF THE INVENTION

Accordingly, the present invention aims to provide a power window apparatus that can stop or reverse the motor for driving the window glass, based on a proper determination, when an object is caught either at the inclined side or the horizontal side of the window glass. The present invention also aims to provide a power window apparatus that can prevent the motor from being erroneously stopped or reversed when no object is caught.

To solve the problems described above, a power window apparatus according to the present invention includes a window glass having a horizontal side and an inclined side at the upper end thereof; a window frame for supporting the window glass; a motor for vertically driving the window glass; and a detecting mechanism for determining whether an object caught between the upper end of the window glass and the window frame is located at the horizontal side or the inclined side. In this power window apparatus, two thresholds are set to different values for the horizontal side and the inclined side, the thresholds for determining whether the object is caught or not; a parameter corresponding to a load torque on the motor is measured; and the measured parameter is compared with the corresponding set threshold to stop or reverse the motor when the parameter exceeds the threshold.

In the power window apparatus, moreover, a first threshold of the two thresholds to determine whether the object is caught between the horizontal side and the window frame, and a second threshold to determine whether the object is caught between the inclined side and the window frame are set; and the level of the second threshold is smaller than that of the first threshold.

Further, the detecting mechanism detects that the object is caught between the inclined side and the window frame, and the second threshold is applied for comparison based on a detection output from the detecting mechanism.

Moreover, the second threshold is applied when the detecting mechanism detects that an object is caught between the inclined side and the window frame, and the first threshold is applied when the detecting mechanism detects that no object is caught therebetween.

The present invention achieves the following by applying the above-described mechanisms.

In the power window apparatus according to the present invention, a plurality of thresholds are preset and compared so that the maximum allowable squeezing force is not applied to the object caught, regardless of the position, at the upper end of the window glass vertically moved. Thus, the object can be protected from damage and scratches, and further, the motor can be prevented from erroneously stopped or reversed.

Even if an object is caught at the inclined side of the window glass, the motor can be stopped or reversed, by lowering a threshold, for preventing a force that exceeds the maximum allowable squeezing force from being applied to the object.

Moreover, when no object is caught at the inclined side, the motor can be prevented from being erroneously stopped or reversed by immediately returning the threshold to the previous value.

DESCRIPTION OF THE PREFERRED EMBODIMENTS

Figure 1:
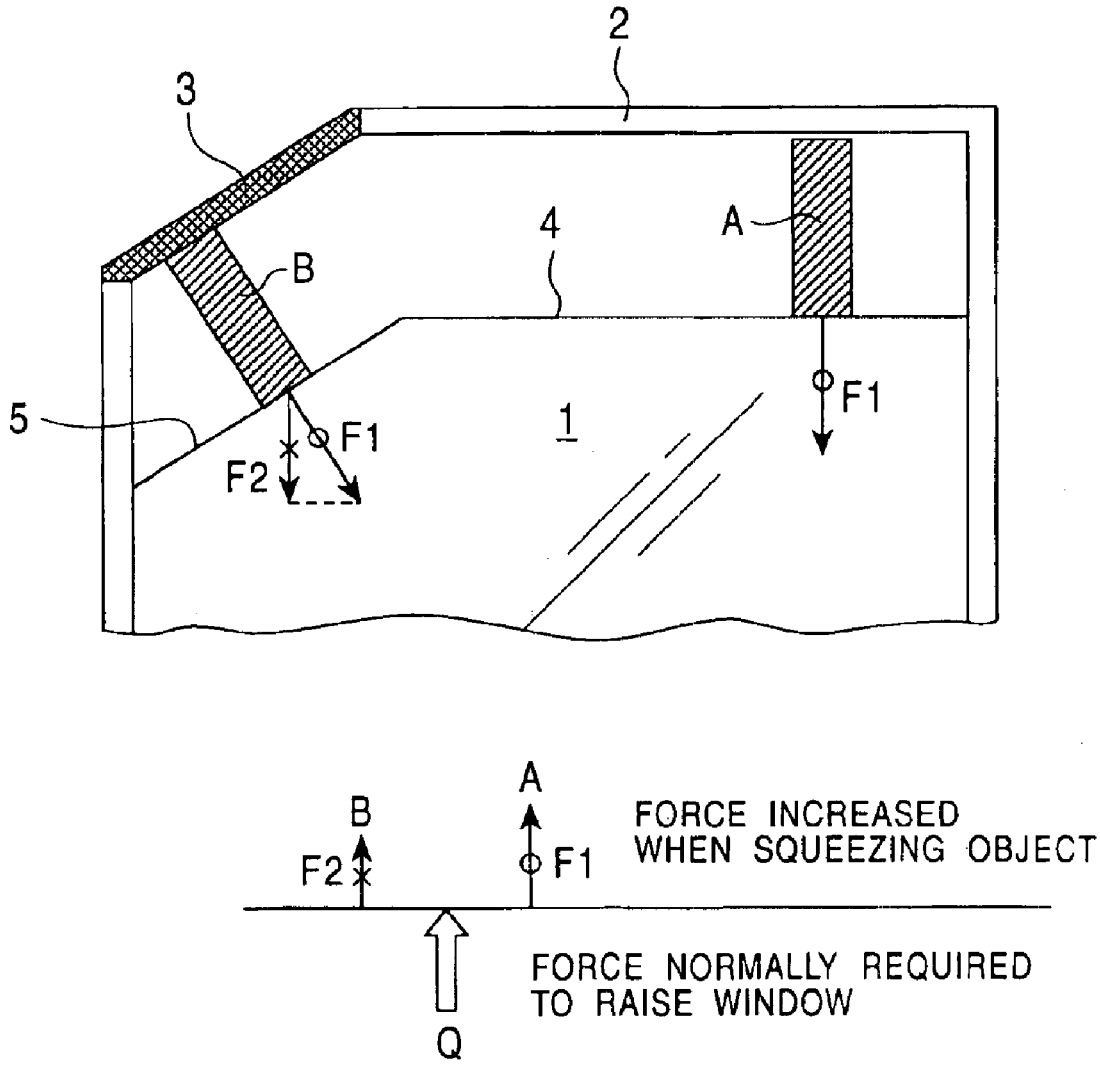
FIG. 1 shows an overall structure, a mechanism, and a state of the power window apparatus when an object is caught, according to an embodiment of the present invention.
Figure 2:
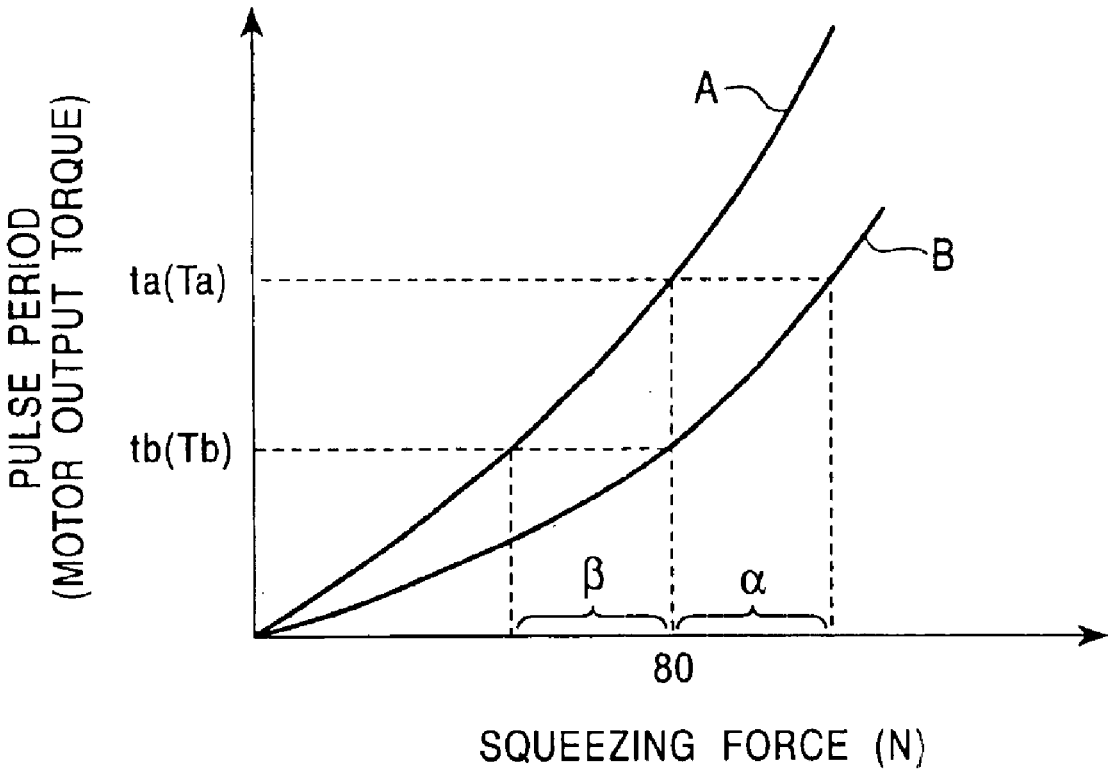
FIG. 2 illustrates a relationship between a squeezing force applied to an object A or B being caught, and a pulse period (motor output torque)
Figure 3:
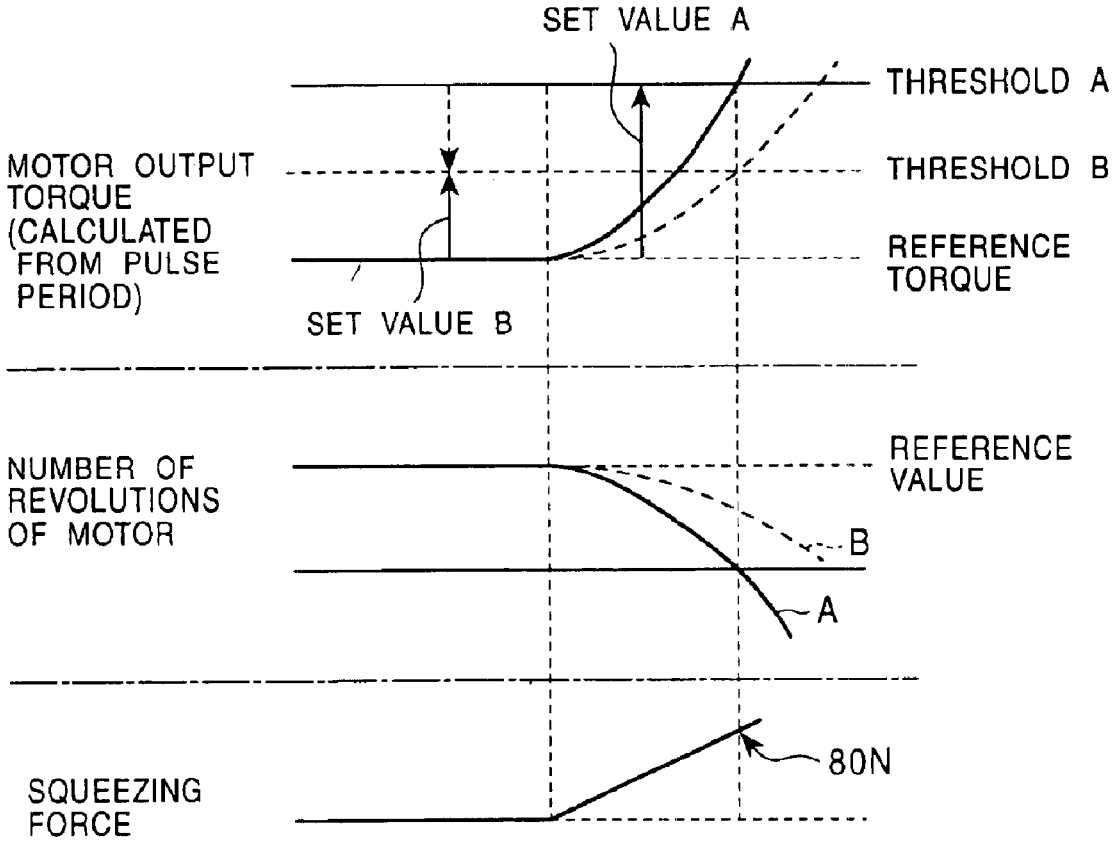
FIG. 3 shows a relationship between a motor output (load) torque, the number of revolutions of the motor, and a squeezing force.
Figures 4A, 4B:
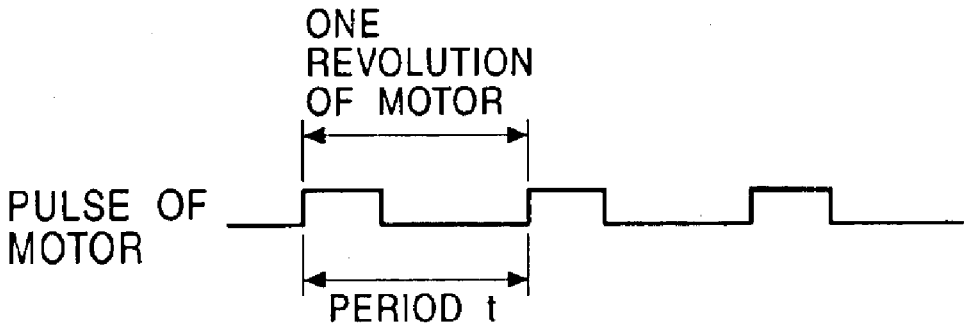
FIG. 4A shows a waveform of a revolution pulse of the motor.
FIG. 4B shows a characteristic equation of the motor output torque.

The power window apparatus having a mechanism for detecting that an object is caught, according to an embodiment of the present invention, will be further described with reference to the drawings. FIG. 1 shows an overall structure, a mechanism, and a state of the power window apparatus when an object is caught, according to an embodiment of the present invention. FIG. 2 illustrates a relationship between a squeezing force applied to the objects A or B being caught, and a pulse period (motor output torque). FIG. 3 shows a relationship between a motor output (load) torque, the number of revolutions of the motor, and a squeezing force. FIG. 4A shows a waveform of a revolution pulse of the motor. FIG. 4B shows a characteristic equation of the motor output torque.

Referring to FIG. 1, a window glass 1 in a power window apparatus of a vehicle is vertically moved by a motor (not shown) within a window frame 2. Each of the window glasses 1 on front seats of a vehicle, especially of an automobile, normally has an inclined side 5 in front and a horizontal side 4 at the back. In the power window apparatus, an object may be caught between the window frame 2 and the window glass 1, either at the horizontal side 4 (A) or the inclined side 5 (B). To protect the caught object from damage, scratches, and the like, the motor for driving the window glass needs to be stopped when the same level of squeezing force is applied to the caught object either at the horizontal side 4 or at the inclined side 5. That is, the motor needs to be stopped or reversed when the squeezing force applied to the object exceeds the same maximum allowable level when an object is caught either at the horizontal side 4 or at the inclined side 5.

As shown in FIG. 1, a force Q is normally required to raise the window glass 1 when no object is caught. When the object A is caught at the horizontal side 4, the motor load torque is determined by adding a squeezing force F1 imposed on the object A to the force Q. On the other hand, when the object B is caught at the inclined side 5, the motor load torque is determined by adding F2 (vertical component of the squeezing force F1) to the force Q.

When the motor is placed under a load, the motor output (load) torque is determined by detecting varying pulse periods or pulse frequencies from a pulse generator provided to the motor. FIGS. 4A and 4B show the basic principle. As shown in FIG. 4A, for example, the pulse generator generates a pulse waveform in cooperation with one revolution of the motor. Further, an output torque $\tau$ of the motor is defined in FIG. 4B. When a voltage V applied to the motor is constant, the output torque $\tau$ corresponds to a pulse period t or pulse frequency 1/t (and therefore, to the number of revolutions of the motor). In other words, the output torque $\tau$ of the motor corresponds to the pulse periods derived from the pulse generator. The output (load) torque of the motor can thus be calculated from the pulse periods derived from the pulse generator.

FIG. 2 shows the relationship between the squeezing force and the increase of the motor output torque, the squeezing force applied to the object A (caught at the horizontal side 4) and the object B (caught at the inclined side 5). Here, the squeezing force exceeding, for example, 80 N (maximum allowable squeezing force) is assumed to be inappropriate due to the risk of damage to the caught object. For the object B caught at the inclined side 5, the motor must be stopped or reversed when an increase tb of the pulse period (increase Tb of the motor output torque), which indicates that the squeezing force reaches 80 N, is detected. For the object A caught at the horizontal side 4, the motor must be stopped or reversed when an increase ta of the pulse period (increase Ta of the motor output torque), which indicates that the squeezing force reaches 80 N is detected. The pulse period may be replaced with any other parameter that can detect the motor load torque corresponding to the squeezing force applied to the object being caught either at the horizontal side or the inclined side. For example, the pulse period may be replaced with a pulse frequency, the number of revolutions of the motor, or a driving current to the motor.

FIG. 3 shows the motor output (load) torque that is applied to the object A (at the horizontal side) and the object B (at the inclined side 5), and is calculated from the pulse period. FIG. 3 also shows the change of the number of revolutions of the motor. As the squeezing force increases, the number of revolutions of the motor gradually decreases (for both the objects A and B). For the object B, a decrease in the number of revolutions of the motor is not significant (this is obvious because an increase in the motor load torque is not significant) compared to that in the object A.

Referring back to FIG. 2, in the case of the object A at the horizontal side 4, the motor is stopped or reversed when the increase ta of the pulse period, which corresponds to the squeezing force of 80 N, is detected. However, if this condition is applied to the object B at the inclined side 5, the squeezing force applied to the object B is (80 N+α), when the increase ta of the pulse period is detected. This exceeds the limit of the squeezing force (maximum allowable squeezing force of 80 N) applied to the object. In the case of the object B at the inclined side 5, the motor is stopped or reversed when the increase tb of the pulse period, which corresponds to the squeezing force of 80 N, is detected. However, if this condition is applied to the object A at the horizontal side 4, the squeezing force applied to the object A is (80 N−β), when the increase tb of the pulse period is detected. This is below the maximum allowable squeezing force of 80 N. Even if no object is caught at the horizontal side, in this case, some friction applied to the window glass may cause the motor to stop.

In the embodiments of the present invention, therefore, a detecting mechanism is provided for detecting that an object is caught at the inclined side 5 of the window glass 1. The main feature of the present invention is that a threshold for controlling the motor to stop is lowered only when this detecting mechanism detects that contact occurs.

FIG. 1 shows a mechanism for detecting that an object is caught at the inclined side 5. On one side of the window frame 2 that opposes the inclined side 5, rubber covers facing each other are normally provided for introducing the edge of the window glass 1 therebetween. The covers are provided with electrodes to define a contact sensor 3 functioning as a detecting mechanism. The electrodes are provided along substantially the entire length of the inclined side 5. The electrodes are long, in parallel, normally separate, and are provided in a pair. When an object is caught between the inclined side 5 of the window glass 1 and the covers, a pressure from the object causes the covers to bend, and further, causes the pair of electrodes to be short-circuited. Although the mechanism incorporating the electrodes has been described here, the contact sensor 3 may include any other mechanisms that can detect an object caught at the inclined side 5. Besides a short circuit between electrodes, a capacitive detecting mechanism that can detect the change of the distance between electrodes may be used.

With reference to FIG. 3, the operation of an embodiment according to the present invention, in the case when the contact sensor 3 detects that an object is caught at the inclined side, will now be described. In a diagram showing a motor output torque calculated from a pulse period, a reference torque refers to a torque created by a normal friction at the window glass when no object is caught. A threshold A is determined by adding a set value A to the reference torque. When a motor output torque reaches the threshold A, the motor for driving the window glass is stopped or reversed. As similarly described in Japanese Unexamined Patent Application Publication No. 11-62380 mentioned above, the reference torque is set within the entire range where an object can be detected, the range included in the entire moving range of the window glass. Here, the set value A is an increase in the motor output torque, as shown in FIG. 2, or a slightly modified value of the increase. The increase in the motor output torque adopted here corresponds to the squeezing force 80 N (maximum allowable squeezing force) applied to the object A at the horizontal side 4.

When the contact sensor 3 detects the object B, the set value is lowered from the set value A to a set value B. A threshold B is thus determined by adding the reference torque to the set value B. Similarly to the set value A, the set value B is an increase in the motor output torque, as shown in FIG. 2, or a slightly modified value of the increase. The increase of the motor output torque adopted here corresponds to the squeezing force 80 N (maximum allowable squeezing force) applied to the object B at the inclined side 5. When the motor output torque (calculated from the pulse period) reaches the threshold B, the motor for driving the window glass is stopped or reversed. Subsequently, when the contact sensor 3 detects the removal of the object B, the set value B is changed to the set value A. The reason for this change is, as shown in FIG. 2, to prevent the motor from being erroneously stopped or reversed when the squeezing force is (80−β), which is below the maximum allowable value.

Although the inclined side 5 described above is linear, the inclined side may be curved. The method used to determine an appropriate set value for the linear inclined side 5 can also be applied to the curved inclined side. That is, in FIG. 3, the appropriate threshold B can be set between the reference torque and the threshold A. Although the contact sensor 3 is provided on the inclined side for changing the threshold, another contact sensor may also be provided on the part of the window frame that opposes the horizontal side of the window glass, so that detection outputs from these contact sensors can be used. The point is that the detection outputs from the contact sensors are used to prevent the force exceeding the maximum allowable squeezing force from being applied to the object, which is caught at the upper end of the window glass regardless of the position (either at the horizontal side or the inclined side). Moreover, the detection outputs from the contact sensor are also used to prevent the motor from being erroneously stopped or reversed when no object is caught.

What is claimed is:

1. A power window apparatus comprising:

a window glass having a horizontal side and an inclined side at an upper end thereof;

a window frame for supporting the window glass;

a motor for vertically driving the window glass; and a detecting mechanism for determining whether an object caught between the upper end of the window glass and the window frame is located at the horizontal side or the inclined side;

wherein two thresholds are set to different values for the horizontal side and the inclined side, the thresholds for determining whether the object is caught or not;

a parameter corresponding to a load torque on the motor is measured; and the measured parameter is compared with the corresponding set threshold to stop or reverse the motor when the parameter exceeds the threshold.

2. The power window apparatus according to claim 1, wherein a first threshold of the two thresholds to determine whether the object is caught between the horizontal side and the window frame, and a second threshold to determine whether the object is caught between the inclined side and the window frame are set; and the level of the second threshold is smaller than that of the first threshold.

3. The power window apparatus according to claim 2, wherein the detecting mechanism detects that the object is caught between the inclined side and the window frame, and the second threshold is applied for comparison based on a detection output from the detecting mechanism.

4. The power window apparatus according to claim 3, wherein the second threshold is applied when the detecting mechanism detects that an object is caught between the inclined side and the window frame, and the first threshold is applied when the detecting mechanism detects that no object is caught therebetween.

* * * * *